US007533834B2

(12) United States Patent
Gründl et al.

(10) Patent No.: US 7,533,834 B2
(45) Date of Patent: May 19, 2009

(54) FUEL INJECTION VALVE FOR COMBUSTION ENGINES

(75) Inventors: Andreas Gründl, München (DE); Bernhard Hoffmann, Starnberg (DE)

(73) Assignee: Compact Dynamics GmbH, Starnberg (DE)

( * ) Notice: Subject to any disclaimer, the term of this patent is extended or adjusted under 35 U.S.C. 154(b) by 397 days.

(21) Appl. No.: 10/554,713

(22) PCT Filed: Feb. 2, 2004

(86) PCT No.: PCT/EP2004/000929

§ 371 (c)(1),
(2), (4) Date: Jun. 15, 2006

(87) PCT Pub. No.: WO2004/097207

PCT Pub. Date: Nov. 11, 2004

(65) Prior Publication Data

US 2007/0175436 A1 Aug. 2, 2007

(30) Foreign Application Priority Data

Apr. 29, 2003 (DE) ..... 103 19 285

(51) Int. Cl.
*F02M 51/00* (2006.01)

(52) U.S. Cl. ..... 239/585.5; 239/585.3; 239/585.1; 251/129.09; 251/129.16; 335/266

(58) Field of Classification Search ..... 239/585.1, 239/585.3, 585.4, 585.5; 251/129.09, 129.16; 335/266, 268, 299
See application file for complete search history.

(56) References Cited

U.S. PATENT DOCUMENTS

| | | | | |
|---|---|---|---|---|
| 4,156,506 | A | 5/1979 | Locke et al. | |
| 5,035,360 | A | 7/1991 | Green et al. | |
| 5,207,410 | A | 5/1993 | Wakeman | |
| 6,065,684 | A | 5/2000 | Varble et al. | |
| 6,155,503 | A * | 12/2000 | Benson et al. | 239/585.1 |

(Continued)

FOREIGN PATENT DOCUMENTS

DE 10005182 A1 8/2001

(Continued)

OTHER PUBLICATIONS

Forms PCT/ISA/210 and 220 International Search Report for PCT/EP04/000929, May 14, 2004.

*Primary Examiner*—Steven J Ganey
(74) *Attorney, Agent, or Firm*—Wood, Herron & Evans, LLP

(57) ABSTRACT

A fuel injection valve for fuel injection systems of combustion engines, in particular for the direct injection of fuel into a combustion chamber of a combustion engine, comprising a fuel inlet which is adapted to have fuel flow into the fuel injection valve, an electrically controllable actuation means which cooperates with a valve arrangement in order to cause the fuel in a directly or indirectly controlled manner to exit into the combustion chamber through a fuel outlet, with the actuation means comprising a magnet coil arrangement to be supplied with current, an essentially soft magnetic magnet yoke arrangement cooperating with same, as well as an essentially soft magnetic magnet armature arrangement cooperating with same, with the magnet yoke arrangement and/or the magnet armature arrangement comprising a configuration which reduces eddy currents.

20 Claims, 6 Drawing Sheets

U.S. PATENT DOCUMENTS

| | | | | |
|---|---|---|---|---|
| 6,651,913 | B1 * | 11/2003 | Greif | 239/585.1 |
| 6,892,971 | B2 * | 5/2005 | Rieger et al. | 239/585.1 |
| 2001/0019085 | A1 | 9/2001 | Okajima et al. | |

FOREIGN PATENT DOCUMENTS

| | | |
|---|---|---|
| FR | 2194888 | 3/1974 |
| JP | 10335139 A | 12/1998 |

* cited by examiner

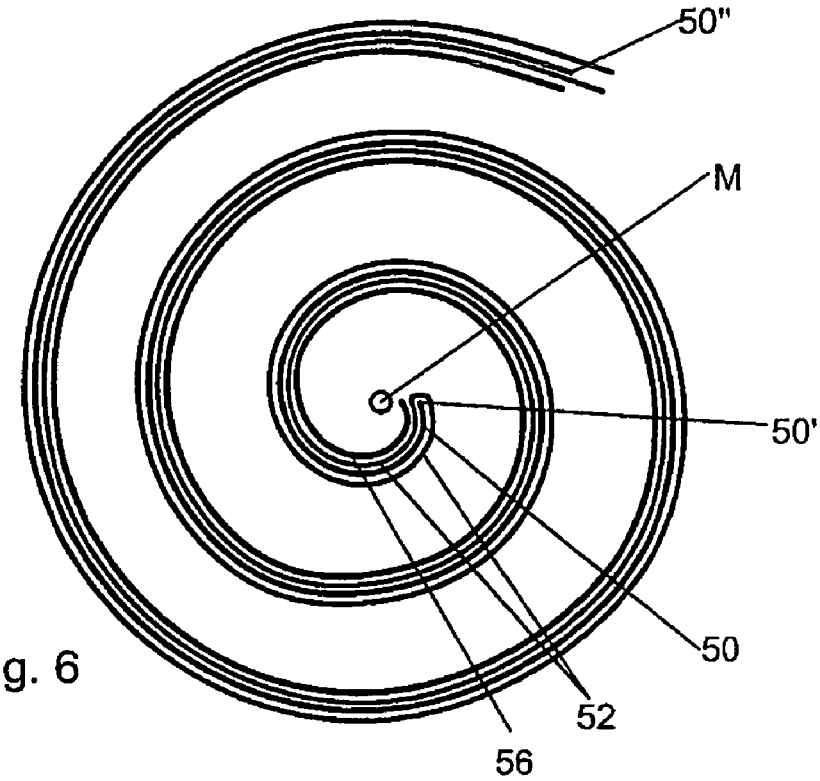
Fig. 6
Fig. 7
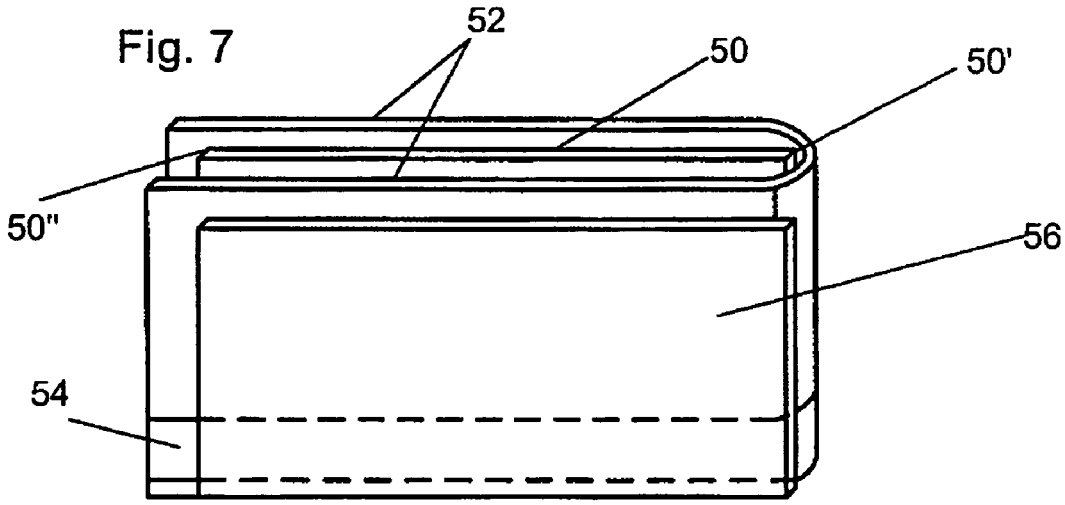

FUEL INJECTION VALVE FOR COMBUSTION ENGINES

BACKGROUND OF THE INVENTION

The invention relates to a fuel injection valve for fuel injection systems of combustion engines, in particular for the direct injection of fuel into a combustion chamber of a combustion engine. It is principally possible, to apply the invention both to directly injecting as well as to conventional engines injecting into the suction pipe.

The inventive fuel injection valve has a fuel inlet which is adapted to have fuel flow into the fuel injection valve, and an electrically controllable actuation means which cooperates with a valve arrangement in order to cause the fuel in a directly or indirectly controlled manner to exit into the combustion chamber through a fuel outlet. The electromagnetic actuation means comprises an electromagnet coil arrangement to be supplied with current, an essentially soft magnetic magnet yoke arrangement cooperating with same, as well as an essentially soft magnetic magnet armature arrangement cooperating with same.

In view of the continuously increasing requirements imposed by the exhaust gas legislation with continuously decreasing limits, the automotive combustion engine industry is facing the challenge to optimise the generation of pollutants at the site of their generation by an optimisation of the injection process of fuel into the combustion chamber. $NO_x$ and soot emissions are particularly critical. The development of injection systems with ever increasing injection pressures and highly dynamic injectors, as well as the cooled exhaust gas recirculation and oxidation catalysts at least enables to meet the present limits. It seems, however, that the potential of the previous measures for a reduction of emissions is almost exhausted. This places special emphasis on variable injection process forms. Here, the fuel injection rate is selectively varied by multiple injection or by a specific modulation of the stroke of the nozzle needle.

STATE OF THE ART

A fuel injection valve of the above-mentioned type is known in the most different configurations from several manufactures (Robert Bosch, Siemens VDO Automotive). These known arrangements, however, suffer from the drawback that the number of strokes per working cycle of the combustion engine is very restricted. They are, in particular, unable to provide the required number of multiple injections per working cycle which in high-speed combustion engines are necessary for an efficient engine management. Furthermore, the precise variation of the stroke of the valve needle in these arrangements is also possible to a very limited degree only. In both aspects, the conventional electromagnetic actuation means have proven to be a restricting factor for the advanced development of efficient fuel injection valves.

A known approach to overcome this restriction is to provide a piezo linear actuator in lieu of the electromagnetic actuation means. Apart from the high costs and the relatively large installation space of the piezo linear actuator, its temperature-dependent behavior in the immediate vicinity of the combustion chamber of a combustion engine is disadvantageous. Moreover, piezo drive of present construction allow only 3 to 5 injection processes per working cycle of the combustion engine, with opening/closing cycles of approx. 100 μs being realisable. As a whole, the employment of this type of fuel injection valves in large-scale series vehicles has not succeeded. In addition, the stroke travel of a piezo linear actuator is very limited with a given installation length and is presently increased to approx. 100 to 200 μm by means of expensive lever arrangements. Finally, the precise modulation of the stroke of the nozzle needle by means of the piezo linear actuator is still difficult, owing to the high dynamics and the ever increasing pressures in the combustion chamber, in particular with the Diesel direct injection.

From DE 100 05 182 A1 an electromagnetic injection valve is known for controlling a fuel quantity to be fed into a combustion engine, comprising a valve body which may be actuated by an electromagnet coil system, with the valve body cooperating with an armature of the magnet of the electromagnet coil system. The decisive feature of the arrangement is that the electromagnet coil system comprises at least two coils with identical characteristics, which are arranged symmetrically and concentrically to the centre longitudinal axis and integrated in a magnetic circuit in such a manner that a first pole body each is arranged between two neighbouring coils and the inner and outer coil each are arranged adjacent to a second pole body. It is also of importance that the pole bodies are dimensioned in such a manner that a radial intersection area of the central first pole body corresponds to the sum of the intersection areas of the neighbouring second pole body. As a whole, the function of this arrangement is significantly dependent on the symmetry of the spatial configuration of the electromagnet coil system. The time delay of the build-up of the electric and magnetic field primarily depends on the geometry of the magnetic circuit and, in particular, of the field diffusion and the occurring eddy currents.

Unfortunately, the necessary constructive and electric/magnetic symmetry of the electromagnet coil system, such as e.g. the dimensioning or the ratio, respectively, of the radial intersection area of the pole bodies of this arrangement represents a considerable restriction. Moreover, with this known arrangement, too, the achievable valve switching times, valve travels, and valve closing forces have to be judged as inadequate.

Problem on Which the Invention is Based

Accordingly, there is the problem with known fuel injection valves to provide a compact and economic arrangement of a fuel injection valve which has a long-term stability and is suited for the application in large scale series and which is capable of carrying out a sufficiently high number of strokes per working cycle of the combustion engine with the required opening/closing forces. The present invention aims at providing such fuel injection valves.

Inventive Solution

The invention solves this problem with the valve arrangement of the above-mentioned type in that the magnet yoke arrangement comprises several pole lands which at least partially are surrounded by electromagnet coil arrangements which are adapted to guide a reverse electrical current each at opposite flanks of the pole lands. Namely, it was surprisingly found that it is not necessary to change from an electromagnet actuation means as valve drive to a piezo linear actuator with all its inherent problems and drawbacks. Rather, the inventive configuration of the components of the electromagnetic actuation means is able to achieve that the fuel injection valve cannot only provide the required opening/closing forces for Otto engines, but even the required opening/closing forces for a Diesel direct injection with considerably more strokes per working cycle (at least twice as many as a piezo linear actuator of the present construction) with an electromagnetic actuation means.

In other words, the inventive valve arrangement allows the realisation of opening/closing cycles of approx. 40 to 50 μs and less. Thus, multiple injection operations for an efficient motor management are possible, both for Otto engines and for Diesel engines. In addition, it is also possible to increase the fuel flow rate through the fuel injection valve in that with the inventive valve arrangement the stroke travel of the valve member at a comparable stroke time may be approximately 3 to 6 time longer than with a piezo linear actuator of the present construction. Moreover, the inventive arrangement allows to very precisely control the variation of the stroke travel with time. The state of the art (e.g. from DE 100 05 182 A1) requires a centrally symmetric geometry of the pole lands. Here, the outer iron rings have a smaller cross-section than the inner ones etc. This influences the design of the armature of the magnet. Compared to this, the invention allows the free dimensioning of the magnet yoke, the magnet coil and armature arrangement, which with the invention results e.g. in a relatively light-weight magnet armature with improved valve dynamics.

Developments and Embodiments of the Invention

In a first embodiment of the inventive fuel injection valve the pole lands have a pitch dimension which is approximately 2 to 30 times, preferably approximately 5 to 20 times, and particularly preferably approximately 10 times larger than an air gap formed between the magnet yoke arrangement and the magnet armature arrangement in a rest position of the actuation means. The ratio between the pitch dimension of the pole lands, i.e. a dimension which contributes in the determination of the magnetically effective area of the pole lands, and the air gap is a quantity which considerably influences the functionality of the valve. The invention assumes that the ratio should be in the range from approx. 2 to approx. 30, with any ratio between these limits being covered by the scope of the invention and being primarily dependent on the constructive facts or requirements (available installation diameter, length, required valve stroke, valve member dynamics, etc.).

Due to the fact that the pole lands have an essentially asymmetric shape with respect to the centre longitudinal axis of the fuel injection valve it is prevented that manufacturing inaccuracies or variations in the magnetic field generation, or temperature variations result in undesired operating states. Rather, the non-rotation symmetrical shape of the magnet yoke or the magnet coil, respectively, is considerably more insusceptible in this respect.

In an embodiment of the invention the pole lands have a helical shape with respect to the centre longitudinal axis of the fuel injection valve. In another embodiment of the invention the pole lands have an essentially polygonal, preferably quadrangular shape and are arranged adjacent to one another under the formation of spaces for accommodating the electromagnet coil arrangements, with the pole lands being preferably arranged parallel to one another.

In the latter case at least two neighbouring pole lands may be surrounded at least partially in meander fashion by at least one electromagnet coil arrangement. Alternatively, one pole land each may be at least partially surrounded by at least one electromagnet coil arrangement. One feature of the invention is that at least one electromagnet coil arrangement at least partially encloses non-circular pole lands. This construction with a very efficient manufacture allows the arrangement of a current conducting band for forming the magnet coil arrangement and a sheet metal band containing soft iron for forming a stator yoke back between two layers of sheet metal containing soft iron. The current conducting band and the sheet metal band containing soft iron are adjoining at one longitudinal edge each in an electrically insulated manner.

In order to realise particularly slender or elongated structures with high holding or closing forces, a cascade arrangement of several valve drives along the axis of motion of the valve arrangement may be effected in that the actuation means comprises more than one assembly, the magnet yoke arrangement, and the magnet armature arrangement. These assemblies act collectively on the valve arrangement—either in the same sense or in opposite senses.

According to the invention, the actuation means acts on a movable valve member in order to move it relative to a stationary valve seat which cooperates with the valve member and is arranged downstream of the fuel inlet between an open position and a closed position. Thereby a directly switching valve arrangement can be realised.

In another embodiment of the inventive fuel injection valve the actuation means acts on a movable valve element in order to move it relative to a stationary valve seat which cooperates with the valve member between an open position and a closed position. This enables a controlled drainage of fuel into a return pipe if a second spring-loaded valve element together with a second valve seat is not opened by the pressure prevailing in the combustion chamber, and a controlled drainage of fuel into the combustion chamber, if the second spring-loaded valve element together with the second valve seat is opened by the pressure prevailing in the combustion chamber. Thereby a directly switching valve arrangement can be realised.

According to the invention the magnet yoke arrangement and/or the magnet armature arrangement may be arranged eccentrically or asymmetrically about a centre axis of the fuel injection valve.

In a preferred embodiment the soft magnetic magnet yoke arrangement may be formed of at least two joined dish parts with recesses, with one electromagnet coil arrangement each being accommodated in each recess, which in the direction of movement terminates essentially flush with the respective face of one of the dish parts, with the faces together defining a cavity in which the magnet armature arrangement is supported so as to be movable along the centre longitudinal axis.

The electromagnet coil arrangement may be formed at least on one side of the soft magnetic magnet armature arrangement by one or several electromagnet coils which terminate approximately flush with one of the faces of one of the dish halves.

The individual annular coils may have a thickness of approx. 20 to approx. 80% of the magnet yoke iron. The individual coils on one side of the soft magnetic magnet armature arrangement may also be adapted to be supplied with reverse current.

In addition, the yoke iron may be formed by iron plates which are insulated against one another between the individual coils on at least one side of the soft magnetic magnet armature arrangement.

The invention is based on the principle of orienting the electromagnet coil arrangement and the magnet armature arrangement essentially under right angles relative to one another.

According to the invention the magnet coil arrangement and the magnet armature arrangement may overlap at least partially, preferably completely, in a radial direction relative to the centre longitudinal axis. Thereby a particularly efficient magnetic circuit is realised which allows very short valve opening/closing times.

In an embodiment of the inventive fuel injection valve the magnet yoke arrangement may be configured as an essentially cylindrical soft magnetic disk body with gaps which are oriented radially or tangentially with respect to the centre longitudinal axis. These gaps may be plain slots or, for increasing the stability of the magnet yoke arrangement, may be formed from a material which has a higher magnetic resistance than the material of the soft magnetic disk body.

In another embodiment of the inventive fuel injection valve the magnet armature arrangement may be formed by two or more strip-shaped soft magnetic portions which are spatially separated. In this case, too, the spatial separation may be provided by plain slots or, for increasing the stability, by a material which has a higher magnetic resistance than the material of the strip-shaped soft magnetic portions.

The magnet armature arrangement may be configured as a soft magnetic disk body with recesses, preferably slots or elongated holes which are radially oriented and extend to the edge of the disk. In this case, too, the slots or elongated holes extending to the edge of the disk gaps may be plain recesses or, for increasing the stability, may be formed from a material which has a higher magnetic resistance than the material of the soft magnetic disk body.

The magnet armature arrangement may also be formed as a multilayer construction, with a ceramic layer being arranged between two soft iron layers. This laminated structure is secured at the valve rod. For further improving the stability, the two iron layers may also be joined with each other along the outer circumference.

In addition, the soft magnetic armature arrangement and the valve member may be connected with each other and be biased by a spring arrangement into the open position or the closed position and to be brought into the closed position or the open position by current supply of the magnet coil arrangement.

According to another embodiment of the inventive fuel injection valve two of the above described actuation means may be provided which act on the valve member in the opposite sense and bring same under the respective current supply into the closed or open, respectively, position.

The inventive fuel injection valve may be adapted and dimensioned to protrude into the combustion chamber of a combustion engine with externally supplied ignition or into the combustion chamber of a combustion engine with self-ignition.

Further advantage, embodiments, or modification possibilities will result from the following description of the figures which explains the invention in detail.

BRIEF DESCRIPTION OF THE FIGURES

FIG. 6 is a schematic plan view of a cross-section of a soft magnet yoke arrangement and a magnet coil arrangement according to a third embodiment of the invention.

FIG. 7 is a perspective side view of the soft magnet yoke arrangement and a magnet coil arrangement according to FIG. 6.

DETAILED DESCRIPTION OF CURRENTLY PREFERRED EMBODIMENTS

Figure 1:
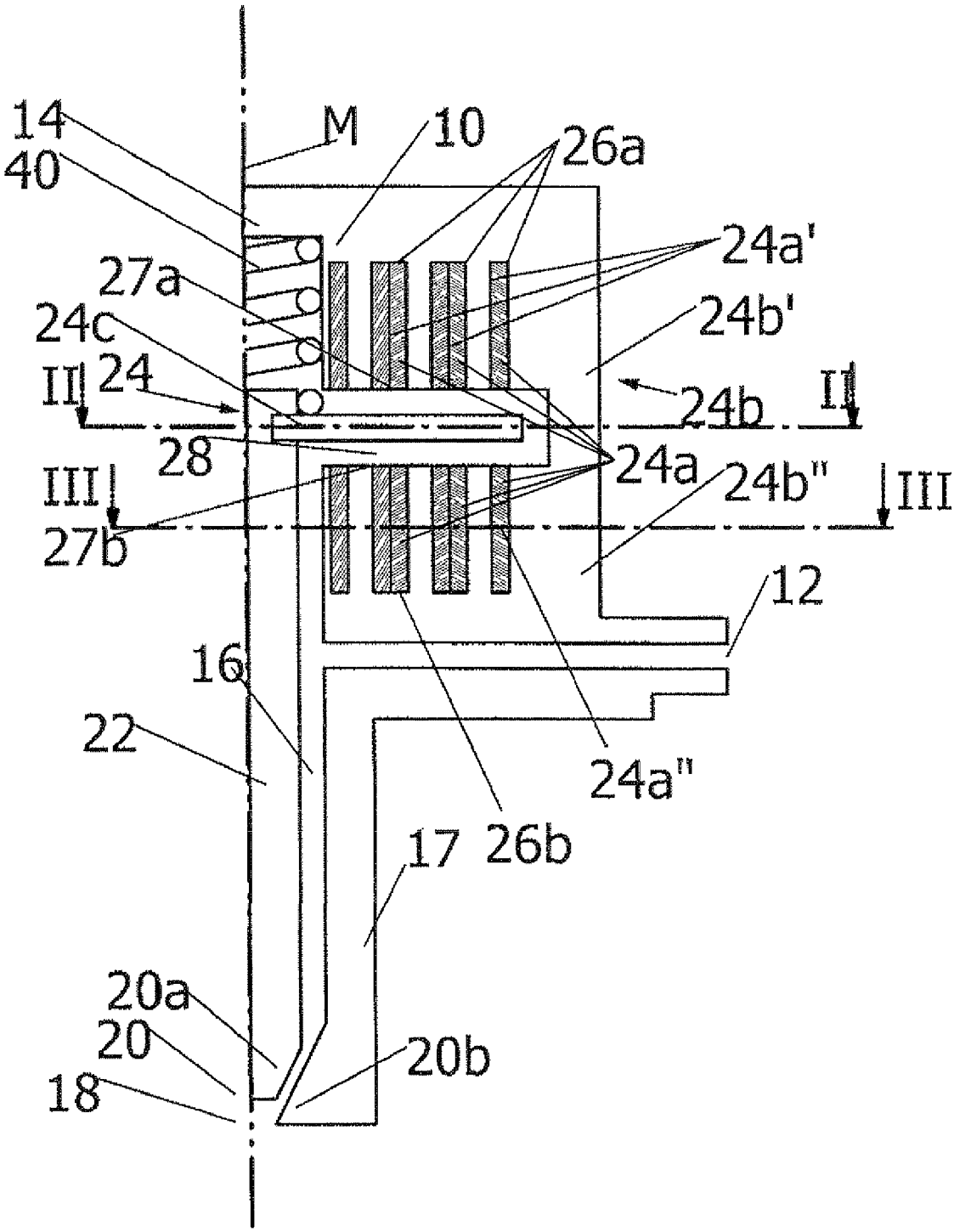
FIG. 1 is a schematic illustration as a longitudinal section through a fuel injection valve according to a first embodiment of the invention.

FIG. 1 shows a fuel injection valve with a valve housing 10 which is essentially rotation-symmetrical about a centre longitudinal axis M as a schematic longitudinal section in a semi-opened position. Such a fuel injection valve serves to directly inject fuel into the combustion chamber, not shown in detail, of a combustion engine. The fuel injection valve 10 has a radially oriented lateral fuel inlet 12 through which fuel may flow into the fuel injection valve which has been pressurised by means of a pump, now shown in detail, or another pressure generator. It is, however, also possible to provide the fuel inlet approximately in the central upper area of the fuel injection valve, which is indicated by 14 in FIG. 1. A central fuel channel 16 extends from the fuel inlet 12 through a pipe 17 to a fuel outlet 18. At the end of the central fuel channel 16 a valve arrangement 20 is provided for causing the fuel to flow out of the fuel outlet 18 and into the combustion chamber of the combustion engine in a controlled manner.

The valve arrangement 20 is formed by a valve member 20*a* located in the central fuel channel 16 and tapered towards the fuel outlet 18 and a valve seat 20*b* cooperating with the valve member 20*a*, which is configured corresponding to the shape of the valve member 20*a*.

The valve member 20*a* is connected with an actuation means 24 which may be electrically driven in order to move the valve member 20*a* between an open and a closed position (in FIG. 1 upwards and downwards). Thereby pressurised fuel from the fuel inlet 12, which flows through the central fuel channel 16 is ejected in a controlled manner through the fuel outlet 18 into the combustion chamber.

Figure 4:
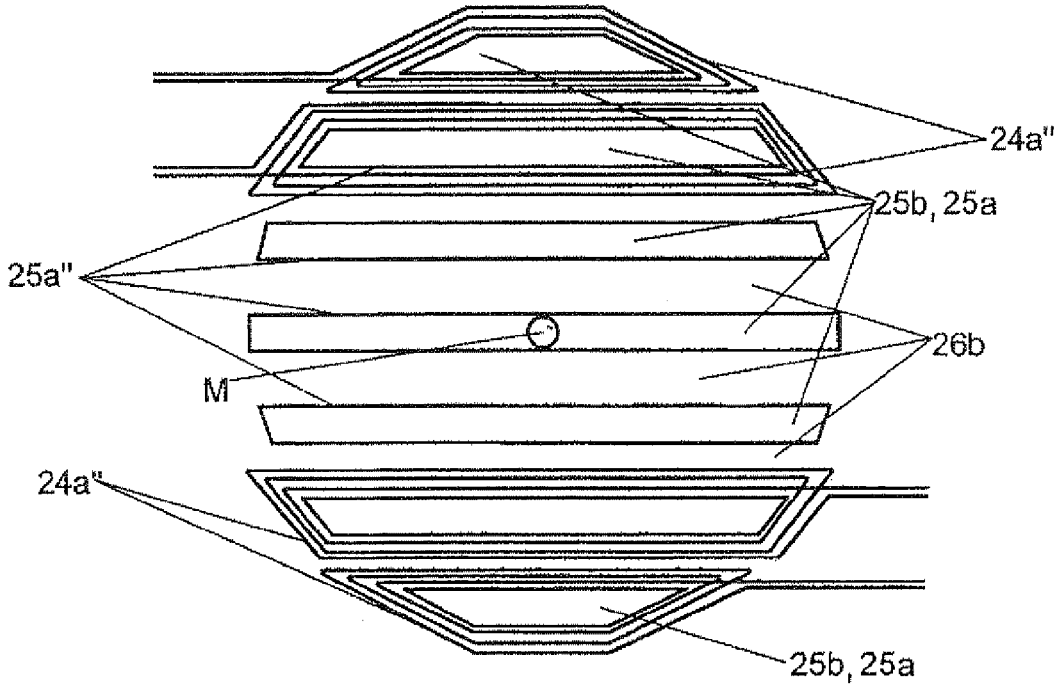
FIG. 4 is a schematic plan view of a soft magnet yoke arrangement with a magnet coil arrangement.
Figure 5:
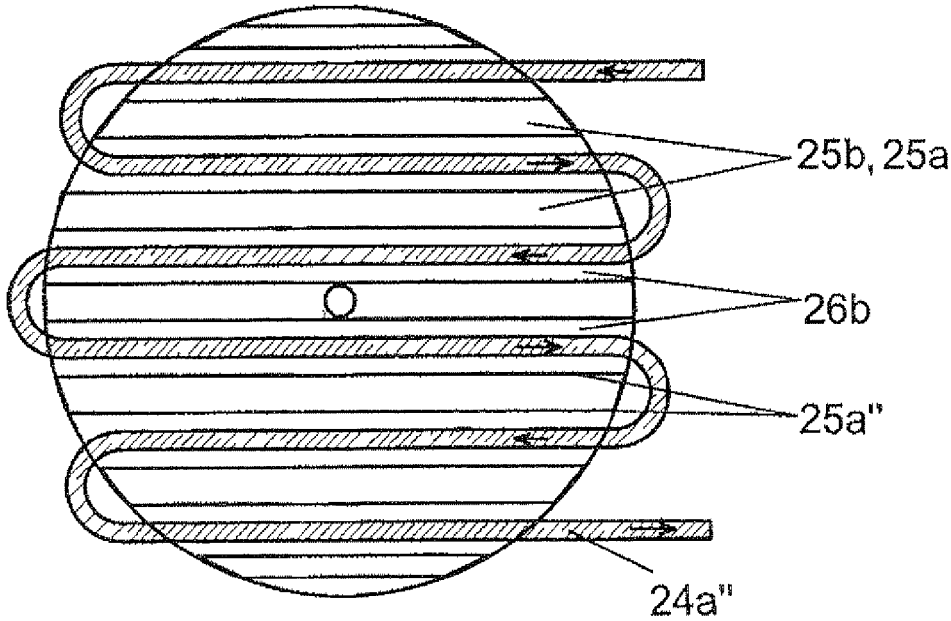
FIG. 5 is a schematic plan view of a cross-section of a soft magnet yoke arrangement and a magnet coil arrangement according to a second embodiment of the invention.

The actuation means 24 is formed by an electromagnet coil arrangement, a soft magnetic magnet yoke arrangement 24*b* cooperating with same, as well as a soft magnetic magnet armature arrangement 24*c* cooperating with same. The soft magnetic magnet yoke arrangement 24*b* is formed by two dish halves 24*b*' and 24*b*" with recesses 26*a*, 26*b*, which are joined approximately at the height of the section line II-II. The recesses 26*a*, 26*b* in the embodiment according to FIG. 1 have the longitudinal extension in the plan view as shown in FIGS. 4 and 5 and are defined by pole lands 25*b* which are also approximately trapezoidal or parallelogram-shaped. In the recesses 26*a*, 26*b* one electromagnet coil arrangement 24*a*' and 24*a*" each is accommodated which terminates flush with the respective faces 27*a*, 27*b* of the dish halves 24*b*' and 24*b*".

The faces 27*a*, 27*b* of the dish halves 24*b*' and 24*b*" define a cavity 28 in which the magnet armature arrangement 24*c* is accommodated so as to be movable along the centre axis M.

In the arrangement shown in FIG. 1 the electromagnet coil arrangements or the magnet yoke arrangements, respectively, have the configuration shown in FIG. 4, wherein the pole lands 25*b* have an essentially quadrangular shape and are arranged adjacent to one another under the formation of spaces for accommodating the electromagnet coil arrangements 24*a*', 24*a*". The pole lands 25*b* are preferably arranged parallel to one another. Here, the magnet yoke arrangement may consist of an integral soft iron from which the pole lands or the spaces, respectively, are formed. Gaps in the form of slots or elongated holes may be formed into such an integral soft iron formed part, which are filled with an electrically insulating material. It is, however, also possible to make the magnet yoke arrangement as a formed part from sintered iron powder or to assemble and adhesively join it, if required, from several individual pieces which are insulated against one another.

Figure 2:
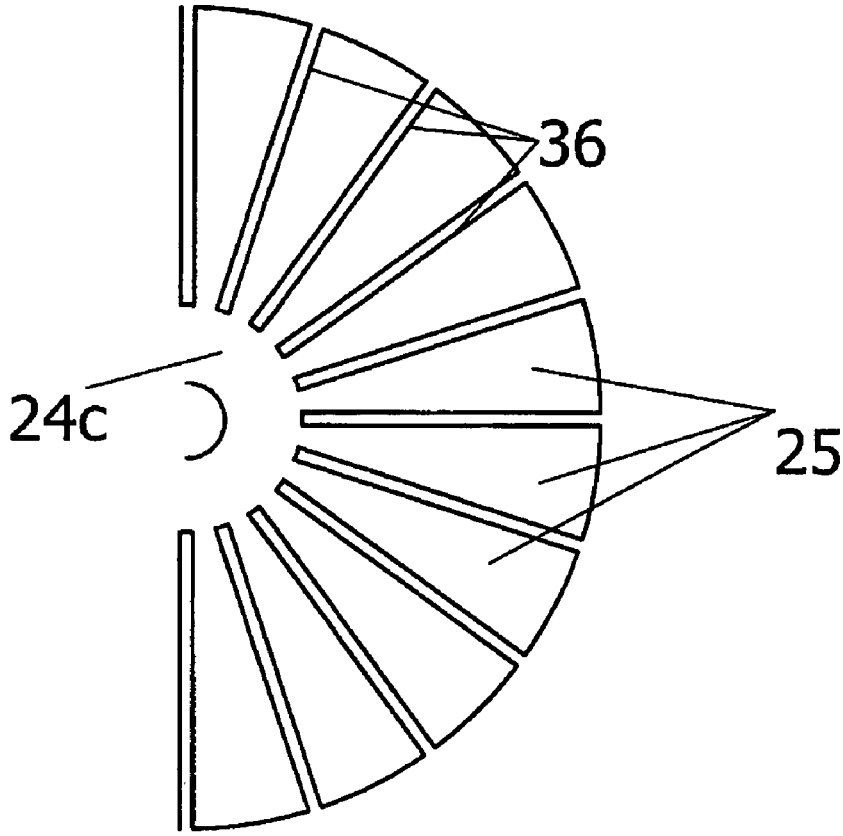
FIG. 2 is a schematic plan view of a cross-section of a soft magnet armature arrangement of FIG. 1 along the line II-II.

FIG. 2 shows the soft magnetic magnet armature arrangement 24*c*. It has a soft magnetic armature disk 24*c* which is arranged about the centre axis M. In order to keep the eddy currents induced in the armature disk 24*c* during operation of the fuel injection valve as low as possible the armature disk 24*c* is provided with radially oriented gaps 36. These gaps have the shape of slots 36 which extend to the edge 30 of the armature disk 24*c*. Thereby radially oriented segments 25 are created which are joined in the centre of the disk 24*c*.

Figure 3:
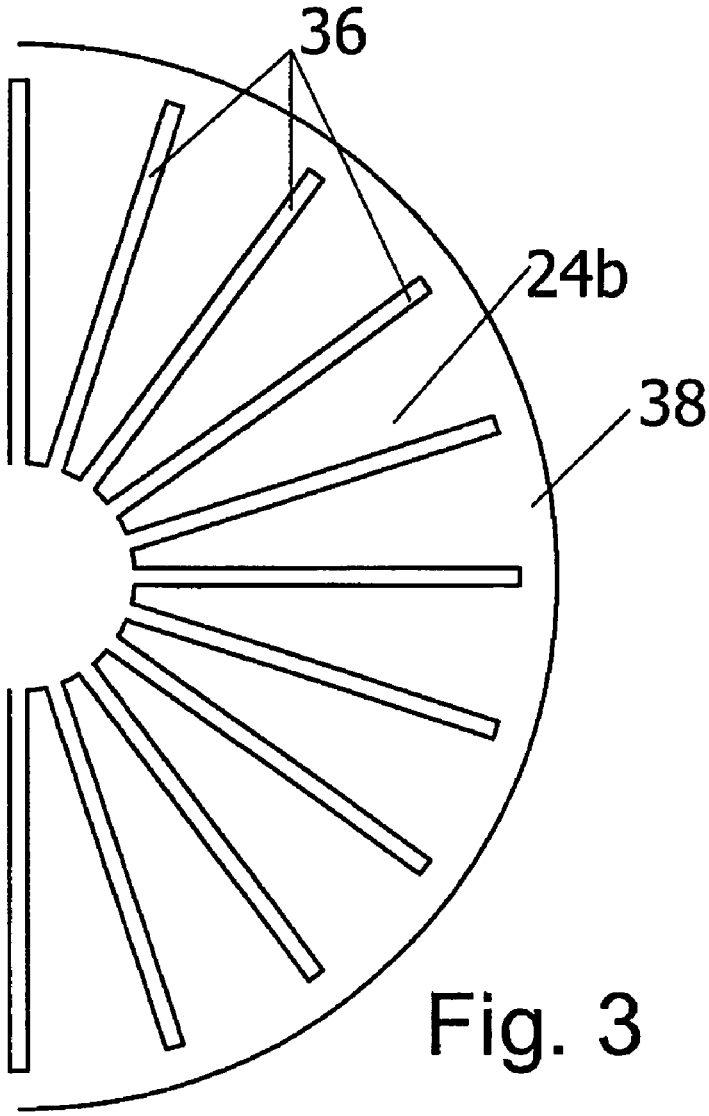
FIG. 3 is a schematic plan view of a cross-section of a soft magnet yoke arrangement of FIG. 1 along the line III-III.

FIG. 3 shows a cross-section of the soft magnetic magnet yoke arrangement 24*b*. In order to keep the eddy currents induced in the magnet yoke arrangement 24*b* during operation of the fuel injection valve as low as possible the magnet yoke arrangement 24*b* is provided with a plurality of radially oriented vertical gaps 36 in the shape of slots. In order to make the fuel injection valve fluid tight a material land 38 is provided between the slots 36 at the outer wall, which provides for a closed shell surface. Alternatively, the closed shell surface may also be provided at the radial inner ends of the slots 36. This brings about the advantage of an improved heat transfer from the magnet yoke. The two dish halves 24*b*' and 24*b*" of the magnet yoke arrangement 24*b* are provided with the slots 36.

From the above it will be apparent that the electromagnet coil arrangement and the radially oriented segments 25 of the soft magnetic armature disk 24*c* may be oriented essentially at right angles to one another. It is understood that this may be realised either in the above described form with the radially oriented segments 25 of the armature arrangement 24*b* and a helical electromagnet coil arrangement or magnet yoke arrangement 24*b*, respectively, or vice versa. But also with armature parts and a star-shaped electromagnet coil arrangement.

The magnet armature arrangement 24*c* is a circular iron-containing disk the shape of which will be described in detail further below. The electromagnet coil arrangement and the magnet armature arrangement 24*c* overlap in the radial direction with respect to the centre axis (M). As shown in FIG. 1 the electromagnet coil arrangement has a smaller outer diameter than the armature disk 24*c* so that the magnetic flux from the electromagnet coil arrangement enters the armature disk 24*c* under virtually insignificant stray losses. Thereby a particularly efficient magnetic circuit is realised which allows very short valve opening/closing times as well as high holding forces.

Independent of the configuration of the magnet yoke or the magnet coil arrangement, respectively, the armature disk 24*c* may also be a continuous circular disk of soft iron, provided the above described configuration of the magnet yoke or the magnet coil arrangement, respectively, ensures that the stray losses or the eddy current losses, respectively, are sufficiently small for the respective application.

As illustrated in FIG. 1 the armature disk 24*c* is rigidly connected with the actuation rod 22 and accommodated in an armature space 34 which is defined by the dish halves 24*b*' and 24*b*" of the magnet yoke arrangement 24*b* and guided for movement in the longitudinal direction in the pipe 17 along the centre axis M. The armature disk 24*c* with the actuation rod 22 is biased by a helical spring 40 which is arranged coaxially to the centre axis M, so that the valve member 20*a* which is located at the end of the actuation rod 22 is seated fluid tight in the valve seat 20*b*, i.e. that it is urged into its closed position. Upon current supply to one of the coils (e.g. 24*a*') of the electromagnet coil arrangement, a low eddy current magnetic field is induced in the magnet yoke arrangement 24*b*, which draws the armature disk 24*c* with the actuation rod 22 towards the relevant dish half 24*b*' in which the current-carrying coil is located. Thereby the valve member 20*a* moves off the valve seat 20*b* into its open position. Upon current supply of the other coil (e.g. 24*a*") of the electromagnet coil arrangement, the valve member 20*a* moves in the relevant other direction towards the valve seat 20*b* into its closed position. A helical coil 40 at the end of the actuation rod 22 far from the valve member 20*a* acts on same and maintains the valve ember 20*a* with the currentless electromagnet coil arrangement in its closed position.

Another embodiment of the invention which is not shown in detail consists in coupling several (two or more) armature disks 24*c* with the valve member 20*a* via the actuation rod 22, onto which a coil yoke arrangement acts from one or from both sides. Moreover, the coil arrangement at both sides of the soft magnetic magnet armature arrangement 24 may be configured as a multiple-part component. In this case, two or more electromagnet coil arrangements 24*a*', 24*a*" are provided which terminate essentially flush with the respective faces 27*a*, 27*b* of the dish halves 24*b*' and 24*b*". This embodiment though of the same installation volume may have an increased magnetic field density and therefore an increased valve member holding force and valve member actuation speed. Through the individual coils on one side (above or below, respectively) of the respective magnet armature arrangement 24*c* a reverse current is alternately flowing. The yoke iron between the individual coils of one side may be formed here by iron plates which are insulated against each other.

The two embodiments are shown with electrically controllable actuation means 24 wherein a central actuation rod 22 is moved by a disk-shaped magnet armature arrangement 24*c*. It is also possible to provide a tube in lieu of the central actuation rod 22, at the face of which the magnet armature is arranged.

In the embodiment of the magnet yoke or the magnet coils, respectively, according to FIG. 4 each individual pole land is surrounded by a separate winding. For the sake of clarity, not all the pole lands are illustrated with electromagnet coil arrangements in FIG. 4. All electromagnet coil arrangements 24*a*' and 24*a*" are either wound in the opposite sense and supplied with equidirectional current, or in the case of equidirectional windings are supplied with reverse current in order to guide a reverse electrical current each at opposite flanks 25*a*', 25*a*" of the pole lands 25*b*.

Alternatively, it is also possible to configure the electromagnet coil arrangement as shown in FIG. 5, wherein one (or several) windings is (are) inserted in meander fashion into the recesses 26*a*, 26*b* between the pole lands 25*b* of the magnet yoke arrangement. In this case, too, reverse electrical current is guided by the opposite flanks 25*a*', 25*a*" of each of the pole lands 25*b*. As can be seen, the pole lands 25*b* (and the recesses 26*a*, 26*b*, too) are essentially asymmetrically arranged with respect to the centre axis M of the fuel injection valve, with at least one electromagnet coil arrangement 24*a*', 24*a*" partially enclosing non-circular pole lands in such a manner that a reverse electrical current is guided by at their flanks.

The embodiment of an electromagnet coil arrangement illustrated in FIGS. 6 and 7 is manufactured as an integrated arrangement with the soft magnetic magnet yoke arrangement which cooperates with it. For this purpose, an elongated yoke plate 50 which contains soft iron is surrounded on either side with a conductor strip 52 by bending same about a longitudinal edge 50' of the yoke plate 50, which in the finished condition will be located in the interior. Adjacent to the conductor strip 52 a sheet metal band 54 containing soft iron is arranged which has exactly the same thickness as the conductor strip 52 and is also bent about the longitudinal edge 50' of the yoke plate 50, which in the finished condition will be located in the interior. The sheet metal band 54 arranged adjacent to the conductor strip 52 serves to form the back of the magnet yoke together with the portion of the yoke plate 50 with which it is in plane contact in the finished condition. The conductor strip 52 protrudes beyond the lateral longitudinal edge 50" of the yoke plate 50, which in the finished condition is located at the outside, at both ends for electric contact making. Then a second layer of an elongated yoke plate 56 which contains soft iron is placed against it so that a laminated structure consisting of the first yoke plate 50, the conductor strip 52, and the sheet metal band 54, as well as of the second yoke plate 56 is generated. This laminated structure is then helically rolled up in the fashion as shown in FIG. 6 in order to obtain the overall structure consisting of a coil and of a yoke. After the helical rolling up the first and second yoke plate 50, 56 are arranged close to one another and the overall structure is a cylindrical wound body. It is understood that the conductor strip 52 is electrically insulated against the soft iron part 50, 54, 56.

The air gap between the magnet yoke arrangement 24*b* and the magnet armature arrangement 24*c* which is coaxial with the centre longitudinal axis M is in the rest position of the actuation means 24 approx. 10 times as large as the pitch dimension of the pole lands. In this embodiment the pitch dimension is the transverse dimension of the pole lands. In the embodiment of the magnet yoke arrangement 24*b* according to FIGS. 6, 7 the pitch dimension is the thickness of the yoke plate 40. Other geometries of the pole lands are also possible. Decisive for the pitch dimension are the smallest structures of the pole lands, i.e. their longitudinal dimensions, transverse dimensions, thicknesses, etc., which result in a finely pitched configuration of the poles of the magnet yoke acting on the magnet armature. This small pitch dimension results in a high magnetic flux density and thus in high attraction or holding forces, respectively, of the valve arrangement or also in a short switching time, respectively, because the electric and magnetic losses or the induced counterforces, respectively, are very small.

Figure 8:
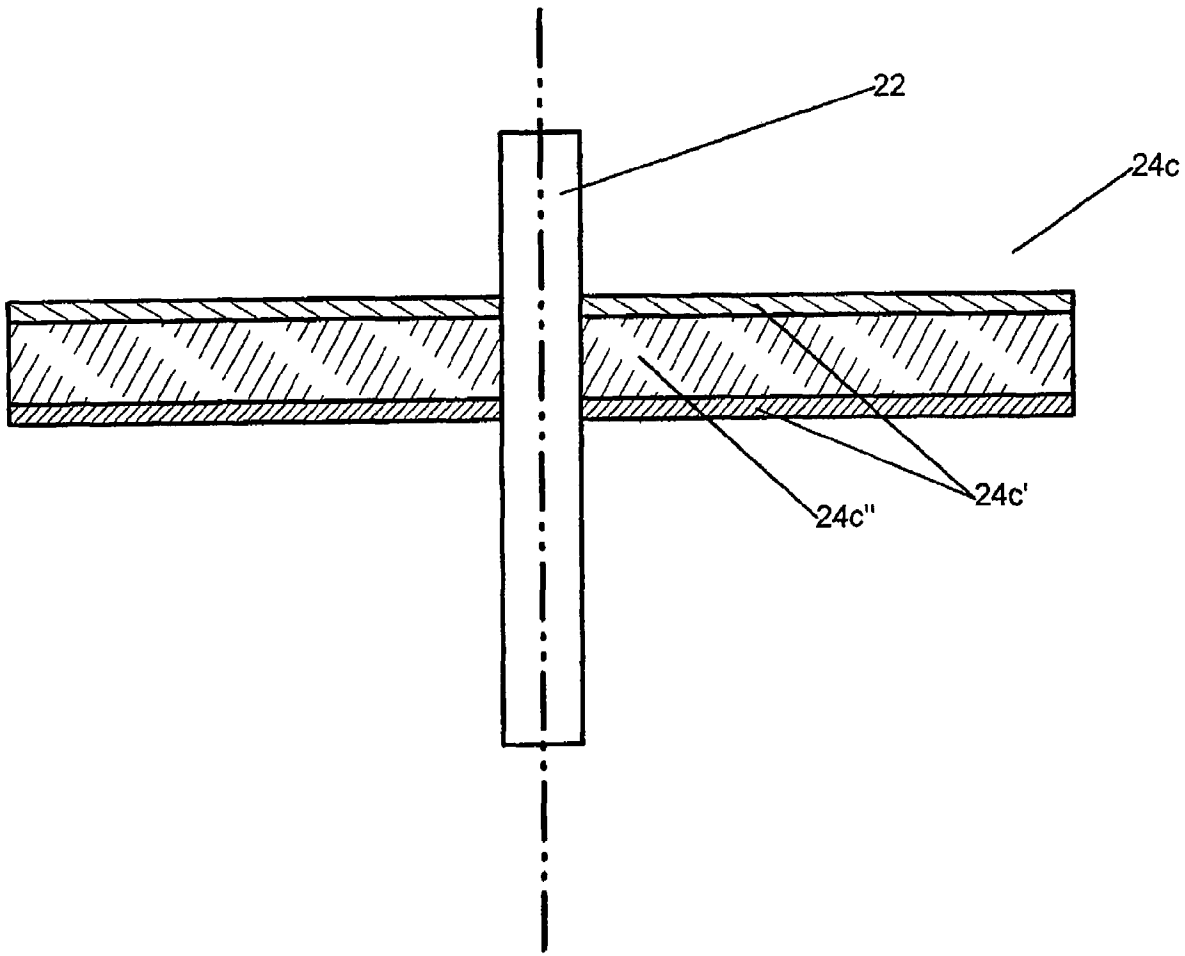
FIG. 8 shows a side view in a partial longitudinal section of the valve rod with an armature arrangement comprising a box profile.

FIG. 8 shows a further alternative for a configuration of the armature arrangement. The armature disk 24*c* is of a multilayer construction. A ceramic layer 24*c*" is arranged and secured at the valve rod 22 between two relatively thin and thus low eddy current soft iron layers 24*c*' for increasing the mechanical stability. It is understood that the two soft iron layers 24*c*' may either be continuous armature disks or disks with recesses as described above. It is also possible to distribute several armature arrangements of this configuration along the valve rod 22.

The invention claimed is:

1. A fuel injection valve for the direct injection of fuel into a combustion chamber of a combustion engine, the fuel injection valve comprising:

a fuel inlet adapted to have fuel flow into the fuel injection valve; and an electrically controllable actuation means which cooperates with a valve arrangement in order to cause the fuel in a directly or indirectly controlled manner to exit into the combustion chamber through a fuel outlet;

the actuation means comprising a magnet coil arrangement to be supplied with current, an essentially soft magnetic magnet yoke arrangement cooperating with the magnet coil arrangement, and an essentially soft magnetic magnet armature arrangement cooperating with the magnet coil arrangement;

the magnet yoke arrangement comprising several pole lands; which are at least partially surrounded by electromagnet coil arrangements that are adapted to guide a reverse electrical current each at opposite flanks of the pole lands;

wherein the pole lands have an essentially polygonal shape and are arranged adjacent to one another under the formation of spaces for accommodating the electromagnet coil arrangements, and are arranged parallel to one another;

at least two neighbouring pole lands being surrounded by at least one electromagnet coil arrangement at least partially in meander fashion;

wherein the magnet coil arrangement and the magnet armature arrangement overlap at least partially in a radial direction relative to a center longitudinal axis of the fuel injection valve.

2. The fuel injection valve according to claim 1, characterized in that the pole lands have an essentially asymmetric configuration with respect to the center longitudinal axis of the fuel injection valve.

3. The fuel injection valve according to claim 1, characterized in that the pole lands comprise a pitch dimension which is 2 to 30 times larger than an air gap formed between the magnet yoke arrangement and the magnet armature arrangement in a rest position of the actuation means.

4. The fuel injection valve according to claim 1, characterized in that one pole land each is at least partially surrounded by at least one electromagnet coil arrangement.

5. The fuel injection valve according to claim 1, characterized in that the actuation means comprises more than one assembly, formed by the magnet coil arrangement, the magnet yoke arrangement, and the magnet armature arrangement, with these assemblies acting collectively on the valve arrangement either in the same sense or in opposite senses.

6. The fuel injection valve according to claim 1, characterized in that the actuation means acts on a movable valve member of the valve arrangement in order to move it relative to a stationary valve seat which cooperates with the valve member and is arranged downstream of the fuel inlet between an open position and a closed position.

7. The fuel injection valve according to claim 1, characterized in that the soft magnetic magnet yoke arrangement comprises at least two joined dish parts with recesses in which one electromagnet coil arrangement each is accommodated, which terminates essentially flush with the respective face of one of the dish parts, with the faces together defining a cavity in which the magnet armature arrangement is accommodated so as to be movable along the center longitudinal axis.

8. The fuel injection valve according to claim 1, characterized in that the electromagnet coil arrangement is formed at least on one side of the soft magnetic magnet armature arrangement by several electromagnet coil arrangements which terminate essentially flush with one of the faces of one of the dish halves.

9. The fuel injection valve according to claim 1, characterized in that the individual coils have a thickness of approximately 20 to approximately 80% of the magnet yoke iron located between two coils.

10. The fuel injection valve according to claim 1, characterized in that the individual coils on one side of the soft magnetic magnet armature arrangement are adapted to be supplied with reverse current.

11. The fuel injection valve according to claim 1, characterized in that the electromagnet coil arrangement and the magnet armature arrangement are oriented essentially under right angles relative to one another.

12. The fuel injection valve according to claim 1, characterized in that the magnet yoke arrangement is configured as an essentially cylindrical soft magnetic disk body with radially oriented gaps.

13. The fuel injection valve according to claim 1, characterized in that the magnet armature arrangement is formed by two or more strip-shaped portions which are spatially separated from each other.

14. The fuel injection valve according to claim 1, characterized in that the magnet armature arrangement is configured as a soft magnetic disk with recesses, preferably slots or elongated holes which are radially oriented and extend to the edge of the disk.

15. The fuel injection valve according claim 1, characterized in that the magnet armature arrangement and the valve member are connected with each other and are biased by a spring arrangement into the open position or the closed position and can be brought into the closed position or the open position by current supply of the magnet coil arrangement.

16. The fuel injection valve according to claim 1, characterized in that the fuel injection valve is adapted and dimensioned to protrude into the combustion chamber of a combustion engine with externally supplied ignition.

17. The fuel injection valve according to claim 1, characterized in that the fuel injection valve is adapted and dimensioned to protrude into the combustion chamber of a combustion engine with self-ignition.

18. The fuel injection valve of claim 1, wherein the pole lands comprise a pitch dimension that is about 5 to about 20 times larger than an air gap formed between the magnet yoke arrangement and the magnet armature arrangement in a rest position of the actuation means.

19. The fuel injection valve of claim 1, wherein the pole lands comprise a pitch dimension that is approximately 10 times larger than an air gap formed between the magnet yoke arrangement and the magnet armature arrangement in a rest position of the actuation means.

20. A fuel injection valve for the direct injection of fuel into a combustion chamber of a combustion engine, the fuel injection valve comprising:

a fuel inlet adapted to have fuel flow into the fuel injection valve; and an electrically controllable actuation means which cooperates with a valve arrangement in order to cause the fuel in a directly or indirectly controlled manner to exit into the combustion chamber through a fuel outlet;

the actuation means comprising a magnet coil arrangement to be supplied with current, an essentially soft magnetic magnet yoke arrangement cooperating with the magnet coil arrangement, and an essentially soft magnetic magnet armature arrangement cooperating with the magnet coil arrangement;

the magnet yoke arrangement comprising several pole lands; which are at least partially surrounded by electromagnet coil arrangements that are adapted to guide a reverse electrical current each at opposite flanks of the pole lands;

wherein the pole lands have an essentially polygonal shape and are arranged adjacent to one another under the formation of spaces for accommodating the electromagnet coil arrangements, and are arranged parallel to one another;

at least two neighbouring pole lands being surrounded by at least one electromagnet coil arrangement at least partially in meander fashion;

wherein the yoke iron is formed by iron plates which are insulated against one another between the individual coils on one side of the soft magnetic magnet armature arrangement.

* * * * *